US010391806B2

(12) United States Patent
Demange et al.

(10) Patent No.: US 10,391,806 B2
(45) Date of Patent: Aug. 27, 2019

(54) PERMANENT STAINING OF VARNISHED SECURITY DOCUMENTS

(71) Applicant: SICPA HOLDING SA, Prilly (CH)

(72) Inventors: Raynald Demange, Montagny-pres-Yverdon (CH); Patrick Veya, Bremblens (CH); Alain Mayer, Saint-George (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 487 days.

(21) Appl. No.: 14/381,846

(22) PCT Filed: Feb. 25, 2013

(86) PCT No.: PCT/EP2013/053653
§ 371 (c)(1),
(2) Date: Aug. 28, 2014

(87) PCT Pub. No.: WO2013/127715
PCT Pub. Date: Sep. 6, 2013

(65) Prior Publication Data

US 2015/0072117 A1 Mar. 12, 2015

(30) Foreign Application Priority Data

Feb. 29, 2012 (EP) ..... 12157511

(51) Int. Cl.
*B42D 25/405* (2014.01)
*B41M 7/00* (2006.01)
(Continued)

(52) U.S. Cl.
CPC ..... *B42D 25/405* (2014.10); *B41M 7/0045* (2013.01); *B41M 7/0054* (2013.01);
(Continued)

(58) Field of Classification Search
None
See application file for complete search history.

(56) References Cited

U.S. PATENT DOCUMENTS 4,804,827 A 2/1989 Jung
6,200,628 B1 3/2001 Rozumek et al.
(Continued)

FOREIGN PATENT DOCUMENTS

CN 101715589 5/2010
DE 36 05 625 2/1987
(Continued)

OTHER PUBLICATIONS

WO 2004/072378, Habik et al., Machine translation via WIPO webiste.*

(Continued)

*Primary Examiner* — Laura C Powers
(74) *Attorney, Agent, or Firm* — Muncy, Geissler, Olds & Lowe, P.C.

(57) ABSTRACT

The disclosure relates to the field of the protection of security documents, especially banknotes, against illegal actions such as robbery or theft. In particular, the present disclosure relates to the field of ink-stained documents that are resistant to chemicals. The disclosed security documents are covered on at least one side by from about 70% to about 90% of a protective varnish and have from about 10% to about 30% of one or more varnish-free areas with one or more varnish-free indentations, the percentages being based on the total surface of the one side of the security document.

13 Claims, 2 Drawing Sheets

(51) Int. Cl.

| | |
|---|---|
| ***B42D 25/29*** | (2014.01) |
| ***B42D 25/378*** | (2014.01) |
| ***B42D 25/40*** | (2014.01) |
| ***E05G 1/12*** | (2006.01) |
| ***E05G 1/14*** | (2006.01) |

(52) U.S. Cl.

CPC ..... *B42D 25/29* (2014.10); *B42D 25/378* (2014.10); *B42D 25/40* (2014.10); *E05G 1/12* (2013.01); *E05G 1/14* (2013.01); *B42D 2033/04* (2013.01); *B42D 2033/28* (2013.01); *Y10T 428/24802* (2015.01); *Y10T 428/24917* (2015.01)

(56) References Cited

U.S. PATENT DOCUMENTS

| | | | | |
|---|---|---|---|---|
| 8,920,663 | B2 | 12/2014 | Keller | |
| 2004/0023008 | A1* | 2/2004 | Rosset | D21H 19/40 428/195.1 |
| 2006/0141255 | A1* | 6/2006 | Muller | B42D 25/00 428/403 |
| 2009/0038490 | A1 | 2/2009 | Gygi | |

FOREIGN PATENT DOCUMENTS

| | | |
|---|---|---|
| DE | 10124630 | 11/2002 |
| DE | 102009052538 | 5/2011 |
| EP | 0 256 170 | 2/1988 |
| EP | 2002 988 | 12/2008 |
| JP | 2004351762 | 12/2004 |
| JP | 2006 039775 | 2/2006 |
| JP | 2006338218 | 12/2006 |
| JP | 2008137252 | 6/2008 |
| NL | 1 031 039 | 8/2007 |
| WO | 01/08899 | 2/2001 |
| WO | 02/094577 | 11/2002 |
| WO | 2004/072378 | 8/2004 |
| WO | 2006/021856 | 3/2006 |
| WO | WO2008/128714 | 10/2008 |

OTHER PUBLICATIONS

WO 2002/094577, Habik et al., Machine Translation via WIPO website.*

International Preliminary Report on Patentability in related application No. PCT/EP2013/053653, dated Sep. 2, 2014.

Chinese Office Action in related application No. 201380011643, dated Jul. 14, 2015.

Australian Office Action in related application No. 2013225159, dated Jul. 29, 2015.

Russia Office Action conducted in counterpart Russia Appln. No. 2014138928 (dated Feb. 1, 2016) (w/ English language translation).

Japanese office action in counterpart Japanese Application No. P2014-559162 dated Sep. 6, 2016 (and English language translation).

Indian First Examination Report (FER) in counterpart Indian Application No. 5622/DELNP/2014 dated Dec. 4, 2018, 6 pages.

* cited by examiner

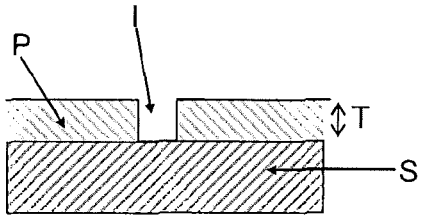
Fig. 1A
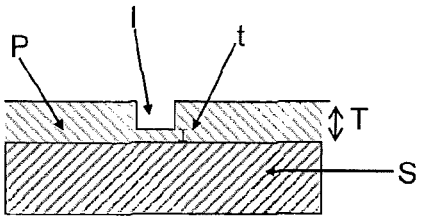
Fig. 1B
Fig. 2
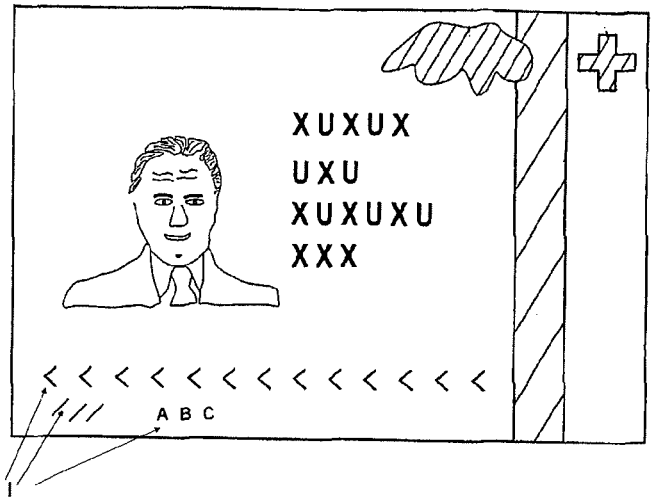

PERMANENT STAINING OF VARNISHED SECURITY DOCUMENTS

FIELD OF THE DISCLOSURE

The present disclosure relates to the field of the protection of security documents, especially banknotes, against illegal actions such as robbery or theft. In particular, the present disclosure relates to the field of ink-stained documents that are resistant to chemicals.

BACKGROUND OF THE DISCLOSURE

Because banknotes and similar documents are theft-attractive, protective storage devices have been developed so as to keep them in a protective casing. Staining (also referred in the art as neutralizing) of banknotes is a security measure occurring due to the activation of anti-theft devices equipped in cash-in-transit (CIT) vans, automatic teller machines (ATMs), security cases, safes or safety boxes. For example, banknotes stored or stacked in an enclosure or banknotes transported in bundles are placed into closed and locked containers which also contain a cartridge with a specific ink. Upon any unauthorized attempt or breach to open the container, a specific ink, often called staining ink (also referred in the art as indelible ink), will be ejected or delivered. In case of an unauthorized attempt or breach of security, the staining ink comes in contact with the banknotes, thus allowing the migration of the ink on and between the banknotes stored and stacked or piled in the enclosure, thereby staining them and permanently and irreversibly marking them by obtaining a typical, well visible or recognizable change.

Known existing alternatives to staining comprise chemical and/or mechanical ways including for example the perforation or mutilation of the banknotes. However, such systems are complex and require complicated machinery and a fair amount of power. Chemical solutions have been devised and include without limitation smoke generators (e.g., smoke dyes) or strong acids such as chlorosulfonic acid. However, smoke dyes are not highly robust and strong acids are likely to impair health and environment.

Consequently, staining inks are commonly used as a protection of banknotes against robbery or theft and are used for invalidating them by permanently damaging or defacing by staining those that have been stolen and, which are thus unusable and unfit for circulation. Permanently ink-stained security documents are ideally easily perceived by the naked eye.

On another hand, with the aim of increasing the durability and cleanliness and thus the circulation lifetime of security documents, in particular banknotes, it has been a conventional practice to protect the security document with a protective varnish so as to provide a protective varnished document. In addition to the increased durability through soiling or chemical resistance, protecting the surface of a banknote simultaneously increases the durability and resistance of overt (i.e. visible to the unaided human eye) and covert (i.e. visible or detectable only with the help of an instrument) security features.

Unfortunately, however, varnished security documents may suffer from a poor ability to retain the staining ink. Should the varnished security document retain a small amount of the staining ink due to small cracks, pinhole spots, or defects of the protective varnish arising upon exposure to external conditions, the quantity of said retained ink would nevertheless be not significant enough to be easily detected by visual human authentication, would be easily confused with normal wear, and might therefore be wrongly kept in circulation.

There remains a need for an efficient and universal technology to make varnished security documents, in particular banknotes, sensitive to staining ink in case of an illegal process, said technology being suitable for any anti-theft machines and any staining ink. Therefore, a need remains for varnished security documents, in particular banknotes, exhibiting a satisfactory staining retention and/or adsorption while maintaining good resistance to chemicals so as to remain permanently damaged or defaced, and thus be unusable and unfit for circulation.

SUMMARY

It has been surprisingly found that the above mentioned problems can be overcome by a security document covered on at least one side by from about 70% to about 90% of a protective varnish and comprising from about 10% to about 30% of one or more varnish-free areas comprising one or more varnish-free indentations, the percentages being based on the total surface of the one side of the security document.

Also described herein are methods for applying the protective varnish described herein on a security document, in particular the banknote, said method comprising a step of applying by a process selected from the group consisting of offset, gravure and flexo printing, preferably flexo printing, the protective varnish on at least one side on the security document so as to cover from about 70% to about 90% of the total surface of the one side of the security document by the protective varnish and wherein the total surface of the one side of the security document comprises from about 10% to about 30% of the one or more varnish-free areas described herein.

Also described herein are uses of the security document described herein for preventing distribution of the security document after theft by contacting the security document with a staining ink.

Also described herein are uses of the one or more varnish-free areas comprising the one or more varnish-free indentations described herein on at least one side of the security document for improving the staining ink absorption capability of the security document, wherein the varnish-free areas are present in an amount from about 10% to about 30% on said at least one side of the security document, the percentages being based on the total surface of the one side of the security document.

Also described herein are methods of authenticating the security document covered on at least one side by from about 70% to about 90% of the protective varnish described herein and comprising from about 10% to about 30% of the total surface of the one side of the security document of the one or more varnish-free areas, said method comprising a step of contacting the security document with a staining ink and a step of verifying the presence of the staining ink on the surface of the security document.

BRIEF DESCRIPTION OF THE DRAWINGS

The disclosure can be explained with the help of the following figures:

FIGS. 1A and 1B schematically depict cross sections of a security document comprising a substrate (S), a protective varnish (P) and one or more varnish-free indentations (I).

FIG. 2 schematically depicts a security document comprising one or more varnish-free indentations (I).

DETAILED DESCRIPTION

Figure 3:
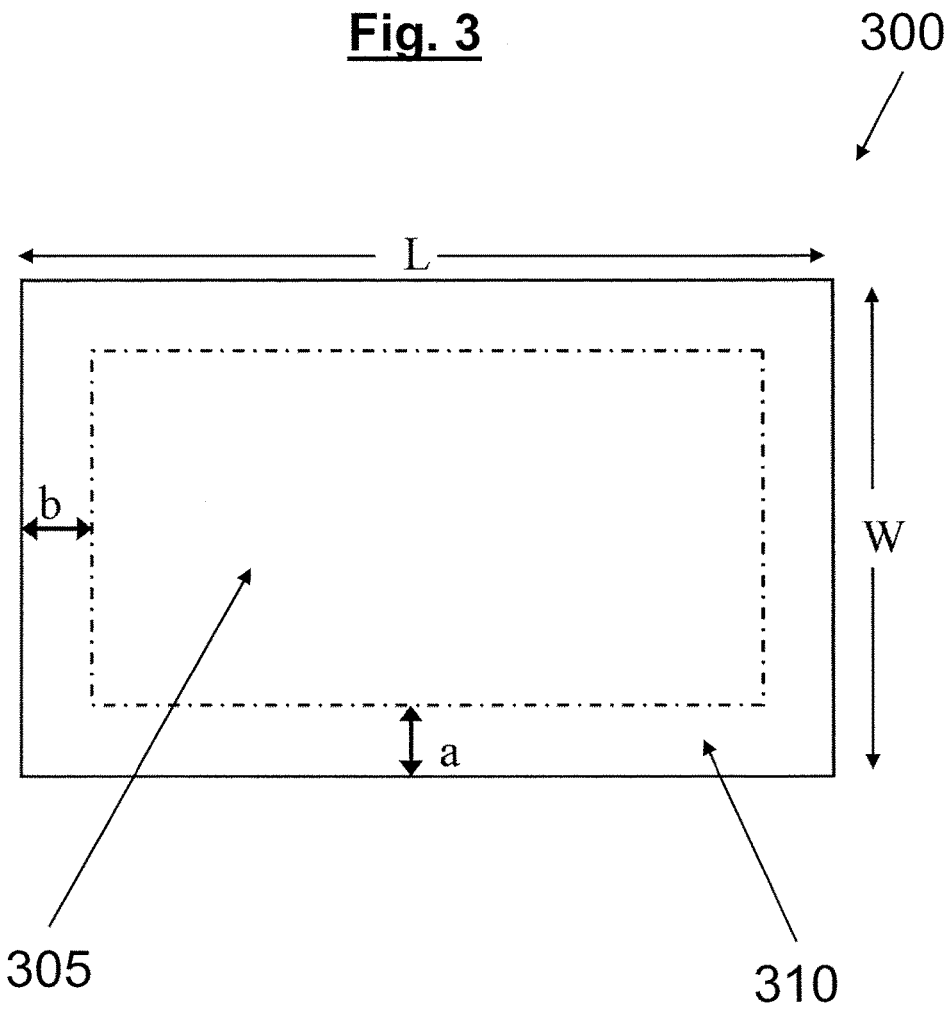
FIG. 3 schematically depicts the edge and/or corner of the security document.

The following definitions are to be used to interpret the meaning of the terms discussed in the description and recited in the claims.

As used herein, the article "a" indicates one as well as more than one and does not necessarily limit its referent noun to the singular.

As used herein, the term "about" should be understood as indicating that the amount or value in question may be the value designated or some other value about the same. The phrase is intended to convey that similar values within a range of ±5% of the indicated value promote equivalent results or effects according to the disclosure.

As used herein, the term "indentation" refers to a recess in a surface. Therefore, the term "recess" may be used interchangeably with the term "indentation".

The term "varnish-free areas comprising one or more varnish-free indentations" means that the varnish-free areas form indentations in the layer of protective varnish applied onto said security document. According to the present disclosure, the term "varnish-free areas comprising one or more varnish-free indentations" also covers embodiments where within a varnish-free area there is thinner layer of protective varnish, as defined in the following paragraph, and in said thinner layer of protective varnish there is at least one indentation.

As used herein the term "varnish-free" refers to "free from the protective varnish" and refers to the presence of the protective varnish in an amount of less than 30%, preferably between about 0% and about 30% and more preferably between about 0% and about 20% in comparison with surfaces covered with the protective varnish, the percent corresponding to a layer thickness percent compared with the average thickness of the protective varnish layer. In other words and as described in FIGS. 1A and 1B, the one or more varnish-free indentations (I) or varnish-free areas have a protective varnish thickness (t) which is less than 30%, preferably between about 0% and about 30% and more preferably between about 0% about and 20% in comparison with the protective varnish thickness (T) of surfaces covered with the protective varnish.

As used herein, the term "protective varnish" refers to any type of varnish, coating or like protective material that may be applied onto the surface on a printed document by a printing or coating process for protecting said document. Varnishing of security documents, in particular banknotes, is especially carried out to increase the durability of the security document, in particular the banknote, put into circulation. Protective varnishes consist of layer(s) or coating(s) facing the environment of the document. Information about the varnishing of banknotes can for instance be found in the following papers:

Tom Buitelaar, De Nederlandsche Bank NV, Amsterdam, the Netherlands, "Effects of Banknote varnishing", Currency Conference CSI, Sydney 1999; Hans A. M. de Heij, De Nederlandsche Bank NV, Amsterdam, the Netherlands, "The design methodology of Dutch banknotes", IS&T/SPIE's 12$^{th}$ International Symposium on Electronic Imaging, Optical Security and Counterfeit Deterrence Techniques III, San Jose, Calif., USA (Jan. 27-28, 2000), Proceedings of SPIE vol. 3973, pp. 2-22;

Frank Wettstein, Cash Division, Swiss National Bank, Berne and Hubert Lieb, Environmental Unit, Swiss National Bank, Zurich, "Life cycle assessment (LCA) of Swiss banknotes", Quarterly Bulletin 3/2000 of the Swiss National Bank, September 2000;

Tom Buitelaar, De Nederlandsche Bank NV, Amsterdam, the Netherlands, "Circulation Fitness Management", Banknote 2003 Conference, Washington D.C., Feb. 3, 2003.

Further information about banknotes and security documents varnishing might be found in European. Pat. App. Pub. No. EP 0 256 170 and in Intl. Pat. App. Pub. No WO 01/08899, WO 02/094577, WO 2004/072378 and WO 2006/021856.

The term "security document" refers to a document which is usually protected against counterfeit or fraud by at least one security feature. Examples of security documents include without limitation banknotes, identity documents, such as passports, identity cards, driving licenses, and the like. Preferably, the security document according to the present disclosure is a banknote.

With the aim of avoiding any premature detrimental influence by soiling of the security document, in particular the banknote, the security document described herein is covered on at least one side by from about 70 to about 90%, preferably from about 75 to about 80%, of a protective varnish and comprises from 10 to 30%, preferably from about 20% to about 25%, of one or more varnish-free areas comprising one or more varnish-free indentations, the percentages being based on the total surface of the one side of the security document. Consequently, from about 10% to about 30%, preferably from about 20% to about 25%, of the total surface of the one side of the security document can be permanently and irreversibly marked with a staining ink. Preferably, and as described hereafter, the security document described herein comprises the one or more varnish-free areas comprising the one or more varnish-free indentations on selected area(s) of the security document, in particular on at least one edge or corner of the substrate, for preventing distribution of said security document after theft by contacting said security document with a staining ink. Preferably, the protective varnish described herein is present on both sides of the security document, in particular the banknote. Preferably, the security document is covered on each side in a surface amount from about 70% to about 90%, preferably from about 75% to about 80%, by a protective varnish for each side, the percentage being based on the total surface of each side of the security document. Same, similar or different amounts of the protective varnish on each side may be used. Since a predominant portion of the at least one side of the banknote is covered with the protective varnish, the security document, preferably the banknote, is protected against soil and/or dirt and has therefore an increased durability and lifetime in comparison with documents lacking a protective varnish on at least one portion of at least one side. Preferably, and as described hereafter, the security document described herein comprises a substrate that, after being put into contact with a staining ink, does not recover its original aspect after a chemical treatment.

The protective varnish may be transparent or slightly colored or tinted and may be more or less glossy. The protective varnish is prepared from a composition in the form of a liquid or pasty composition that is capable of forming a layer or a coating on a solid substrate after curing. The term "curing" refers to processes including the drying or solidifying, reacting or polymerization of the applied composition in such a manner that it can no longer be removed from the surface onto which it is applied.

The protective varnish may be any type of aqueous varnishes or solvent-based varnishes that are dried by infrared and/or thermal radiation (which aqueous varnishes or solvent-based varnishes typically consist of 35% to 50% solid content that remains on the varnished product and 50% to 65% of aqueous or solvent-based solution which is evaporated as a result of drying), radiation-curable varnishes (which radiation-curable varnishes typically consist of 100% solid content that remains on the varnished product following curing) or any combination thereof.

Typical examples of aqueous varnish consist of aqueous dispersion containing components including without limitation resins having an ester bond (e.g., polyester resins, polyether resins), polyurethane resins, polyurethanealkyd resins, polyurethane resins (e.g., carboxylated polyurethane resins), polyurethane alkyd resins, polyurethane-acrylate resins (UV-Vis crosslinkable), urethane-acrylic resins, polyetherurethane resins, styrene acrylate resins or mixtures thereof.

According to a preferred embodiment of the present disclosure, the protective varnish described herein is preferably a radiation-curable composition. "Radiation-curable compositions" refers to compositions that might be cured by UV-visible light radiation (hereafter referred as UV-Vis curable) or by E-beam radiation (hereafter referred as EB). Radiation curing advantageously leads to very fast curing processes and hence drastically decreases the preparation time of security documents. UV-Vis curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited. Preferably the UV-Vis curable composition described herein comprises: a) a binder compound; b) optionally a second binder compound; and optionally c) one or more photoinitiators. The binder compound consists in oligomers (also referred in the art as prepolymers), preferably selected from the group consisting of radically-curable compounds, cationically-curable compounds and mixtures thereof. Preferably, the binder compound consists in oligomers selected from the group consisting of oligomeric acrylates, vinyl and propenyl ethers, epoxides, oxetanes, tetrahydrofuranes, lactones and mixtures thereof, and more preferably the binder compound is selected from epoxy acrylates, acrylated oils, polyester acrylates, urethane acrylates, silicone acrylates, amino acrylates, acrylic acrylates, cycloaliphatic epoxides, vinyl ethers and mixtures thereof. The optional second binder compound is selected from the group of monomeric acrylates such as for example trimethylolpropane triacrylate (TMPTA), pentaerythritol triacrylate (PETA), tripropyleneglycol diacrylate (TPGDA), dipropyleneglycol diacrylate (DPGDA), hexanediol diacrylate (HDDA) and their polyethoxylated equivalents such as for example polyethoxylated trimethylolpropane triacrylate, polyethoxylated pentaerythritol triacrylate, polyethoxylated tripropyleneglycol diacrylate, polyethoxylated dipropyleneglycol diacrylate and polyethoxylated hexanediol diacrylate. The binder compound comprised in the UV-Vis curable composition is preferably present in an amount from about 20 to about 85 wt-%, the weight percent being based on the total weight of the UV-Vis curable composition. UV-Vis curing of a monomer, oligomer or prepolymer may require the presence of one or more photoinitiators and may be achieved in a number of ways. UV-Vis curing may be done by a free radical mechanism, a cationic mechanism or a combination thereof. Depending of the binder compound(s) comprised in the UV-Vis curable composition, different photoinitiators might be used. For example, a binder compound selected from the group consisting of epoxides, oxetanes, tetrahydrofuranes, lactones, vinyl and propenyl ethers and mixtures thereof is typically UV-Vis cured through a cationic mechanism. In the case where the UV-Vis curable composition comprises a binder compound selected from the group consisting of cycloaliphatic epoxides, one or more reactive diluents, preferably trimethylolpropane oxetane (TMPO), may be further comprised in said composition(s) so as to improve the UV-curing speed. Cationic mechanisms consist of the activation by UV-Vis energy of one or more photoinitiators that liberate cationic species, such as acids, which in turn initiate the polymerization of the binder compound(s). Suitable examples of cationic photoinitiators are known to the skilled person and include without limitation onium salts, such as organic iodonium salts (e.g. diaryl iodoinium salts), oxonium (e.g. triaryloxonium salts) and sulphonium salts (e.g. triarylsulphonium salts). Free radical mechanisms consist of the activation by UV-Vis energy of one or more photoinitiators that liberate free radicals, which in turn, initiate the polymerization of the binder compound(s). Suitable examples of free radical photoinitiators are known to the skilled person and include without limitation acetophenones, benzophenones, alpha-aminoketones, alpha-hydroxyketones, phosphine oxides and phosphine oxide derivatives, and benzyldimethyl ketals. Other examples of useful photoinitiators can be found in standard textbooks such as "Chemistry & Technology of UV & EB Formulation for Coatings, Inks & Paints", Volume III, "Photoinitiators for Free Radical Cationic and Anionic Polymerization", 2nd edition, by J. V. Crivello & K. Dietliker, edited by G. Bradley and published in 1998 by John Wiley & Sons in association with SITA Technology Limited. It may also be advantageous to include a sensitizer in conjunction with the one or more photoinitiators in order to achieve efficient curing. The one or more photoinitiators comprised in the UV-Vis curable composition described herein are preferably present in an amount from about 0.1 to about 15 wt-%, preferably from about 1 to about 10 wt-%, the weight percents being based on the total weight of the UV-curable composition.

Alternatively, the protective varnish is prepared from a dual-cure composition combining radiation-curable, preferably UV-Vis curable, components and physically drying components. Typical examples of hybrid compositions include without limitation aqueous dispersions based on aliphatic urethane acrylates and suitable monomers or reactive oligomers, in particular acrylates with one or more photoinitiators.

The protective varnish may further comprise one or more security feature substances, preferably selected from the group consisting of UV, Visible or IR-absorbing materials, luminescent materials, forensic markers, taggants and combinations thereof. Examples are disclosed in U.S. Pat. No. 6,200,628.

The protective varnishes disclosed herein may further comprise one or more additives including without limitation compounds and materials that are used for adjusting physical and chemical parameters, such as the pH value, the viscosity (e.g., solvents), the consistency (e.g., fillers and plasticizers), the foaming properties (e.g., antifoaming agents), the lubricating properties (waxes), the surface energy modifiers (e.g., leveling agents, oleophobing and hydrophobing agents), UV stability (photostabilizers), photosensitizers, cross-linking agents, etc. The protective varnishes disclosed herein may further comprise one or more additives selected from the group consisting of antimicrobial agents, virucidal agents, biocidal agents, fungicides and combinations thereof. Additives described herein may be present in the protective varnish disclosed herein in amounts and in forms known in the art, including in the form of so-called nano-materials where at least one of the dimensions of the particles is in the range of 1 to 1000 nm.

Typical amounts of protective varnish that are applied to security documents, preferably banknotes, are of the order of 1.5 to 3.0 grams per $m^2$ dry weight, preferably from 1.8 to 2.5 grams per $m^2$ dry weight, which quantities are given for the purpose of illustration only. Wherever present, the protective varnish has preferably an average thickness below 5 microns and preferably between about 1 and about 3 microns.

The one or more varnish-free areas comprising one or more varnish-free indentations consist in defined areas of the security document, preferably the banknote, that are free from the protective varnish described herein.

The one or more varnish-free areas comprising one or more varnish-free indentations may further comprise from about 0 to about 50% of one or more varnish-free functional zones (e.g., areas that will be printed for numbering), the percentages being based on the total surface of the one or more varnish-free areas. Preferably, the one or more varnish-free areas comprising one or more varnish-free indentations may further comprise from about 0 to about 50% of one or more varnish-free numbering zones, the percentages being based on the total surface of the one or more varnish-free areas. Preferably, the one or more varnish-free functional zones consist in one or more zones for numbering, wherein these one or more zones are preferably fully free of the protective varnish. According to the present disclosure, "fully free" should be understood as indicating that in a respective area the thickness (t) of the protective varnish is about 0%.

The shape of the one or more varnish-free indentations on selected area(s) of the protective varnish has a pre-defined design and is not limited however; it can be round or spherical, polygonal; it can be lines or guilloches or any desired sign, design or indicia including without limitation symbols, motifs, letters, words, numbers, logos and drawings. Alternatively, the one or more varnish-free indentations on selected area(s) of the protective varnish are designed in such a pattern that they exhibit indicia including without limitation symbols, motifs, letters, words, numbers, logos and drawings.

Preferably, the one or more varnish-free indentations define indicia (i.e., distinctive or identifying marks). Preferably, the one or more varnish-free indentations have a linewidth between about 100 and about 1000 microns, more preferably between about 100 and about 500 microns, and still more preferably between about 100 and about 300 microns depending on their design.

As mentioned above, from about 10% to about 30%, preferably from 20% to about 25% of the total surface of the one side of the security document according to the present disclosure are varnish-free areas, and thus might be permanently and irreversibly marked with a staining ink. Advantageously for security documents, in particular banknotes, comprising the one or more varnish-free areas comprising one or more varnish-free indentations having a specific design, such as for example indicia, lines or guilloches, automatic teller machines (ATMs) used to check the authenticity or the validity of said security documents or automatic banknote counters may be devised to recognize the specific design (such as for example indicia, lines or guilloches) of ink-stained documents arisen from an unauthorized attempt or breach to open the container containing said security documents and sort them out, even if the ink-stained security documents have been washed after the staining process.

Preferably, substrates for use in the present disclosure comprise a material selected from the group consisting of fibrous materials, plastics, polymers, composite materials, metals or metalized materials, and combinations thereof. Typical examples of fibrous materials include without limitation celluloses and paper-containing materials. Typical examples of plastic or polymer substrates include without limitation polypropylene (PP), such as bi-oriented polypropylene (BOPP), polyethylene (PE), polycarbonate (PC), polyvinyl chloride (PVC) and polyethylene terephthalate (PET). Typical examples of composite materials include without limitation multilayer structures and laminates of paper-containing materials and at least one plastic or polymer material and paper-containing materials comprising synthetic fibers. Preferably, the substrate described herein comprises cellulose or a paper-containing material. With the aim of further increasing the security level and the resistance against counterfeiting and illegal reproduction of security documents, the substrate may contain watermarks, security threads, fibers, planchettes, luminescent compounds, windows, foils, decals, coatings, primers, and combinations thereof. With the aim of optimizing the staining of the security document according the present disclosure, preferably the banknote, and the retention of the stain on the ink-stained security document, the one or more varnish-free areas comprising varnish-free indentations are preferably present on at least one edge or corner of the substrate. Preferably, the one or more varnish-free areas comprising varnish-free indentations are present on at least one edge or corner of the substrate, said edge or corner consisting in a framing zone encompassing the borders of the security document, said framing zone being defined by a dimension (a) having of from about 10% to about 15% of the width (W) of the security document described herein and/or a dimension (b) from about 15% to about 25%, of the length (L) of the security document described herein, the percentage being based on the length or the width of the security document as the case may be (see FIG. 3).

When the security document comprises one or more intaglio (also referred in the art as copperplate intaglio or engraved steel die rotary printing) printed areas, it is preferred that the one or more varnish-free areas comprising varnish-free indentations are present on non-intaglio-printed areas.

One or more additional protective layers, sacrificial varnishes or sacrificial layers might be applied on at least a part of the one or more varnish-free indentations, on top of or below the protective varnish and/or on the total surface of the security document. The term "sacrificial varnish" or "sacrificial layer" refers to a varnish or a layer with a lower resistance to staining for example, a varnish with a lower crosslinking degree, a reduced thickness compared to the protective varnish and/or a physical or chemical lower resistance to staining.

Security documents comprise one or more security features. As used herein, the term "security feature" refers to any element on a security document for the purpose of determining its authenticity and protecting it against counterfeits. Typical examples of security features include without limitation cholesteric liquid crystal polymers and pigments, iridescent pigments, thin-film interference pigments, multilayer thin-film interference pigments, interference-layer coated particles, holographic films and pigments, thermochromic pigments, photochromic pigments, ultraviolet-absorbing luminescent compounds, infrared-absorbing compounds, magnetic compounds, forensic markers and taggants as well as threads, windows, fibers, planchettes, foils, and decals. The one or more security features might be present either in the substrate or on the surface of the substrate or a combination of both. When present on the surface of the substrate, the one or more security features are preferably applied or added by any coating or printing method known in the art including without limitation engraved steel plate (also referred in the art as intaglio), silkscreen, offset, letterpress, screen-, flexo, gravure, ink-jet printing, roll-, slit-, spray-, and powder coating. For applying a foil or decal, the generally known methods of heat- or cold-stamping may be used. Should the security document, preferably the banknote, according to the present disclosure comprise one or more security features as described above on the surface of the substrate, the protective varnish would increase the durability and resistance of those security features. In such as case, the protective varnish is either in direct contact with one or more security features or in direct contact with the substrate or is in direct contact with both the one or more security features and the substrate.

The security documents, preferably the banknotes, according to the present disclosure are prepared from sheets or rolls of substrate materials. Downstream the application or insertion of a background, patterns, designs and/or one or more security features when present, the application of the composition, preferably the UV-Vis curable composition, used to prepare the protective varnish is conducted. The application of the composition, preferably the UV-Vis curable composition, used to prepare the protective varnish might be provided either before the numbering process or after the numbering process.

The protective varnish is prepared from the compositions described herein, preferably the UV-Vis curable composition described herein, by forming a layer or a coating on a solid substrate by applying said compositions in the form of a liquid or pasty composition to the substrate described herein by a printing method, and curing the applied layer. The compositions described herein may be prepared by dispersing or mixing the optional security feature substances, the optional additives in the presence of a binder compound and optionally in the presence of the second binder compound, thus forming liquid or pasty compositions. When UV-Vis curable compositions are used for the present disclosure, the one or more photoinitiators may be added to the composition either during the dispersing or mixing step of all other ingredients or may be added at a later stage, i.e., after the formation of the liquid or pasty compositions. Preferably, the printed method used to apply the composition so as to form the protective varnish is selected from the group consisting of offset, gravure and flexo printing and more preferably by a printing method selected from the group consisting of flexo printing so as to ensure a constant protective varnish thickness.

Flexo printing methods preferably use a unit with a chambered doctor blade, an anilox roller and plate cylinder. The anilox roller advantageously has small cells whose volume and/or density determines the protective varnish application rate. The chambered doctor blade lies against the anilox roller, filling the cells and scraping off surplus protective varnish at the same time. The anilox roller transfers the protective varnish to the plate cylinder which finally transfers the protective varnish to the banknote. The specific design of the one or more varnish-free areas comprising varnish-free indentations on the security document according to the present disclosure may be achieved using a designed photopolymer plate. Plate cylinders can be made from polymeric or elastomeric materials. Polymers are mainly used as photopolymer in plates and sometimes as a seamless coating on a sleeve. Photopolymer plates are made from light-sensitive polymers that are hardened by ultraviolet (UV) light. Photopolymer plates are cut to the required size and placed in an UV light exposure unit. One side of the plate is completely exposed to UV light to harden or cure the base of the plate. The plate is then turned over, a negative of the job is mounted over the uncured side and the plate is further exposed to UV light. This hardens the plate in the image areas. The plate is then processed to remove the unhardened photopolymer from the nonimage areas, which lowers the plate surface in these nonimage areas. After processing, the plate is dried and given a post-exposure dose of UV light to cure the whole plate. Preparation of plate cylinders for flexography is described in *Printing Technology*, J. M. Adams and P. A. Dolin, Delmar Thomson Learning, $5^{th}$ Edition, pages 359-360.

The security documents, preferably the banknotes, according to the present disclosure are particularly efficient in terms of adsorption of staining ink in the case of an unauthorized attempt or breach to open a container comprising said security documents, as well as permanently retaining said ink so as to confer to people a typical and well visible way to recognize documents that have been stolen, and are thus unusable and unfit for circulation.

Also described herein are methods for preventing distribution after theft of a security document, preferably a banknote, covered on at least one side by from about 70 to about 90%, preferably from about 75% to about 80%, of the protective varnish described herein, comprising the substrate described herein and which after it has been put into contact with a staining ink does not recover its original aspect after a chemical treatment, said method comprises a step of incorporating the one or more varnish-free areas comprising one or more varnish-free indentations on selected area(s) of the security document, preferably during the preparation of said security document. Also described herein are uses of the security documents described herein for preventing distribution of said security document after theft by contacting said security document with a staining ink. As described above, the one or more varnish-free areas comprising one or more varnish-free indentations consists in a surface from about 10% to about 30%, preferably from about 20% to about 25% of the total surface of the one side of the security document. Typical examples of chemical treatment include aqueous solutions, organic solvents, alkalis and acids, oxidizing and reducing agents and household products. By "recovering its original aspect", it is meant that the ink-stained security document cannot be distinguished with naked eyes from the same security document but not ink-stained. Preferably and as described above, the one or more varnish-free areas comprising the varnish-free indentations described herein are provided on at least one edge or corner of the substrate.

Also described herein are methods for improving the staining ink adsorption capability of a security document, preferably a banknote, comprising the substrate described herein and covered on at least one side by from about 70% to about 90%, preferably from about 75% to about 80%, the protective varnish described herein by incorporating the one or more varnish-free areas comprising the varnish-free indentations described herein on selected area(s) of the security document described herein, preferably during the manufacture of the security document, preferably the banknote. Also described herein are uses of the one or more varnish-free areas comprising one or more varnish-free indentations described herein on at least side of the security document, in particular the banknote, described herein for improving the staining ink absorption capability of the security document, wherein the varnish-free areas are present in an amount from about 10% to about 30% on the at least one side of said security document, the percentages being based on the total surface of the one side of the security document. As described above, the one or more varnish-free areas comprising one or more varnish-free indentations consists in a surface from about 10% to about 30%, preferably from about 20% to about 25% of the total surface of the one side of the security document. Preferably and as described above, the one or more varnish-free areas comprising varnish-free indentations are provided on at least one edge or corner of the substrate.

Also described herein are methods of authenticating an ink-stained security document covered on at least one side by from about 70% to about 90%, preferably from about 75% to 80%, the protective varnish described herein and comprising from about 10% to about 30% of the total surface of the one side of the security document of the one or more varnish-free areas comprising one or more varnish-free indentations described herein, said method comprising a step of contacting the security document, in particular the banknote, with a staining ink and a step of verifying the presence of the staining ink on the surface of the security document.

As described above, staining of security documents, in particular banknotes, occurring due to the activation of anti-theft devices, such as those equipped in cash-in-transit (CIT) vans, automatic teller machines (ATMs) or security cases should lead to documents that are unusable and unfit for circulation, and require the use of a staining ink. The composition of suitable staining ink for the present disclosure is not limited. Typical compositions of staining inks comprise dyes, pigments, dispersants and additives (for the stability of the ink and/or for its functionality such as for example anti-corrosion agents, foaming agents, anti-settling agents etc.) in suitable organic solvents. According to a preferred embodiment of the present disclosure, the staining ink suitable for the present disclosure preferably comprises nanoparticles. The term "nanoparticles" refers to particles where at least one of the dimensions of the particles is in the range of about 1 to about 1000 nm and more preferably in the range of about 1 to about 300 nm. Without being bound by any particular theory, the use of nanoparticles in the staining inks may improve its efficiency. It has been observed on protective varnish substrates comprising some small cracks, pinhole spots or defects of the protective varnish that adding nanoparticles in the staining ink leads to an improved penetration in the substrate of the staining ink compared to staining ink lacking of nanoparticles. The so-obtained protective varnish coated substrates that have been put into contact with the staining ink comprising nanoparticles exhibit stains that are visible, even after washing, giving a "marble-effect" aspect to the substrate. The smaller the particles, the better the penetration in the substrate. The staining ink may further comprise one or more additional security features including without limitation luminescent compounds, IR-absorbing materials, forensic markers, magnetic compounds, taggants and combination thereof.

Also described herein are systems comprising a storing unit with at least one security document described above and a staining ink for contacting the security document when an attempt of unauthorized opening of the storing unit is made. Such a system may be an anti-theft device equipped in cash-in-transit (CIT) vans, automatic teller machines (ATMs) or security cases. In said storing unit, which may be for example a closable and lockable container, a security document such as a banknote is stored or stacked in an enclosure. In addition to said storing unit, the system comprises a cartridge with a staining ink. Upon any unauthorized attempt or breach to open the storing unit, the staining ink will be ejected or delivered. In case of an unauthorized attempt or breach of security, the staining ink comes in contact with the varnish-free areas of the security document, thus staining the security document and permanently and irreversibly marking it by obtaining a typical, well visible or recognizable change.

The present disclosure will now be explained in more detail with non-limiting figures and non-limiting exemplary embodiments.

FIGS. 1A and 1B schematically depict a cross section of a security document according to one embodiment of the present disclosure where the security document comprises a substrate (S), a protective varnish (P) on one side of the security document and one or more varnish-free indentations (I). The protective varnish (P) covers between about 70% to about 90% of the upper surface of the substrate (S). In FIG. 1A there is one varnish-free area in the form of an indentation (I) in the layer of protective varnish (P), said indentation (I) being fully free from the protective varnish (i.e. the thickness (t) of the protective varnish is about 0%). In FIG. 1B, there is one varnish-free area in the form of an indentation (I) in the layer of protective varnish (P). Within said indentation (I), the thickness (t) of the protective varnish (P) is reduced to less than 30% of the thickness (T) of the protective varnish (P) outside the varnish-free areas on the surface of the substrate (S).

FIG. 2 schematically depicts a security document comprising one or more varnish-free indentations (I). In the embodiment of FIG. 2, the indentations define indicia, i.e. the letters A, B and C, diagonal lines and motives.

FIG. 3 schematically depicts a preferred embodiment of the present disclosure where the varnish-free areas comprising varnish-free indentations are present on the edges and corners of the security document 300. The varnish-free areas of this embodiment are present within a framing zone 310 around a central portion 305 of the document 300 that is covered by a protective varnish. The framing zone is defined by a dimension (a) having from about 10% to about 15% of the width (W) of the security document and a dimension (b) from about 15% to about 25%, of the length (L) of the security document, the percentage being based on the length or the width of the security document.

EXAMPLES

The present disclosure is now described in greater detail with respect to non-limiting examples.

TABLE 1

| Ingredients | wt-% |
|---|---|
| cycloaliphatic diepoxide (3,4-Epoxycyclohexane)methyl 3,4-epoxycyclohexylcarboxylate sold as UVACURE ® 1500 by Cytec | 64.2 |
| trimethylolpropane oxetane sold by Perstorp | 12.6 |
| acrylated epoxy resin | 8 |

TABLE 1-continued

| Ingredients | wt-% |
|---|---|
| sold as EBECRYL ® 2959 by Cytec | |
| photoinitiator: a mixture of triarylsulphonium hexafluorophosphate salts in propylene carbonate | 5.4 |
| sold as Speedcure 992 by Lambson | |
| photoinitiator: (4-(2-hydroxyethoxy)phenyl-(2-hydroxy-2-propyl)ketone | 1.5 |
| sold as IRGACURE ® 2959 by BASF | |
| Solution of a polyether modified polydimethylsiloxane | 0.5 |
| sold as BYK ® 330 by Byk | |
| anti-foaming agent: organo-modified polysiloxane with fumed silica | 0.3 |
| sold as Tego Airex900 by Evonik | |
| matting agent; untreated thermal silica | 3.5 |
| Sold as ACEMATT ® TS 100 by Evonik | |
| isopropanol | 4 |
| Viscosity [mPa · s] | 260 |

500 g of protective varnish were prepared by first pre-mixing the three first ingredients of Table 1 and the matting agent (about 15 minutes at 1500 rpm) and then adding the other ingredients of Table 1 and mixing the so-obtained mixture (about 10 additional minutes at 1000 rpm). About 24 hours after the mixing, viscosity was adjusted by adding either the matting agent or the isopropanol so as to obtain a viscosity between 200 and 300 mPa s. Mixing was performed at room temperature with a 10.0 cm dispersing blade. No temperature elevation due to friction was noticeable by hand contact with steel mixing containers. The viscosity given in Table 1 was measured on 9 g of the protective varnish at 25° C. on a Brookfield machine (model "DV-I Prime", small sample adapter, spindle SC4-21 at 100 rpm).

The protective varnish was independently applied to a specimen banknote supplied by KBA NotaSys so as to form a wet coating having a thickness of 2-3 μm (microns) by a laboratory pilot flexo printing unit (N. Schlafli Maschinen) with an anilox (160 l/cm, 8 $cm^3/m^2$) and a printing cylinder of 65-75 Shores. The printing cylinder was either a solid rubber printing cylinder to achieve full varnishing or a flexographic plate (Flint Nyloflex FAH 1.14 mm) with a specific design to achieve varnishing with varnish-free recesses. Three series of notes were prepared as follows:

Series A: four specimen banknotes were fully varnished on both sides with the solid rubber printing cylinder (comparative examples);

Series B: four specimen banknotes were varnished on both sides with the flexographic plate having the specific design, and Series C: four specimen banknotes were fully varnished on one side with the solid rubber printing cylinder and varnished on the other side with the flexographic plate having the specific design.

The design of the flexographic plate was prepared to illustrate the present disclosure and consists of a rectangle of 17.0×10.1 cm divided in 5 subsequent areas:

a rectangle of 10.1×5.1 cm with positive lines of 1000 μm (microns) width alternating with negative lines of 900 μm (microns) width, all the lines being parallel and oriented 60° relative to the axis of the printing cylinder.

a positive rectangle of 10.1×0.9.

a rectangle of 10.1×5.0 cm with positive lines of 600 μm (microns) width alternating with negative lines of 600 μm (microns) width, all the lines being parallel and oriented 135° relative to the axis of the printing cylinder;

a positive rectangle of 10.1×0.9 cm;

a rectangle of 10.1×5.1 cm with positive lines of 500 μm (microns) width alternating with negative lines of 300 μm (microns) width, all the lines being parallel and oriented 30° relative to the axis of the printing cylinder, wherein the positive parts of the design will result in varnished areas whereas the negative parts will result in varnish-free areas.

UV-curing the protective varnish so as to form a radiation cured coating was performed with an on-line UV dryer (system VPC-20 supplied by GEW) comprising a standard mercury UV lamp (ref 14957) at a power of 100% (160 W/cm) and a conveyor speed of 50 m/min. The cured coating had a thickness of 2-3 μm (microns) in the fully varnished areas or in the positive areas of the design and a thickness of about 0 μm (microns) in the negative areas of the design.

200 g of a violet staining ink were prepared by mixing 100 g of Pelikan 4001 ink, 34 g of aqueous pre-dispersion of Pigment Violet 23 (pigment content of 35%) and 66 g of water on a Dispermat F1 equipped with a 4 cm dispersing blade for 10 minutes at about 700 rpm.

Staining of the specimen banknotes from the different series was carried out by individually dipping a specimen banknote for 30 seconds into enough violet staining ink so as to totally cover the specimen banknote. After 30 seconds the specimen banknote was taken out of the staining ink bath and the excess violet staining ink was removed by rinsing the specimen banknote with water.

The result of the staining is determined by visual analysis of the different specimen banknotes. For the series A, the specimen banknotes had a faint violet coloration on only few spots on the specimen banknotes. For series B, the specimen banknotes appeared as striped on their whole surface with lines of faint or no coloration alternating with lines with dark violet coloration. The line width and orientation of the stripes corresponded to the design of the flexographic plate with the lines of faint or no violet coloration corresponding to the varnished areas and the lines with dark violet coloration corresponding to the varnish-free areas. For the series C, the side varnished with the specific design appeared as striped on its whole surface with lines of faint or no coloration alternating with lines of dark violet coloration. The line width and orientation of the stripes corresponded to the design of the flexographic plate with the lines of faint or no violet coloration corresponding to the varnished areas and the lines with dark violet coloration corresponding to the varnished-free areas. The side fully varnished had a faint violet coloration on few spots on the note. In addition the stripes from the design on the opposite side could be seen weakly as it went through the specimen banknote paper.

The specimen banknotes were subsequently subjected to chemical washings. Two specimen banknotes of each series were dipped at room temperature in a mixture of 100 g aqueous sodium hypochlorite (bleach) at a 2.5% w/w concentration and 100 g of a 5% aqueous hydrochloric acid solution. After one minute the specimen banknotes were removed and dried between 2 paper towels. Two specimen banknotes of each series were dipped at room temperature in a dimethylformamide (DMF) bath for 24 h. The notes were removed and dried in between 2 paper towels.

The results of the chemical washings were similar for the bleach/hydrochloric acid treatment and the DMF treatment. These results are determined by visual analysis of the different specimen banknotes. For the series A, the specimen banknotes recovered almost their native appearance and looked almost new with only a faint violet coloration on few spots on the specimen banknote. For series B, the specimen banknotes appeared as striped on their whole surface with lines of faint or no coloration alternating with lines with dark violet coloration. The line width and orientation of the stripes corresponded to the design of the flexographic plate with the lines of faint or no violet coloration corresponding to the varnished areas and the lines with dark violet coloration corresponding to the varnish-free areas. For the series C, the side varnished with the specific design appeared as striped on their whole surface with lines of faint or no coloration alternating with lines of dark violet coloration. The line width and orientation of the stripes corresponded to the design of the flexographic plate with the lines of faint or no violet coloration corresponding to the varnished areas and the lines with dark violet coloration corresponding to the varnished-free areas. The side fully varnished had a faint violet coloration on only few spots on the specimen banknotes. In addition the stripes from the design on the opposite side could be seen weakly as it went through the specimen banknote paper.

As shown by the results, the present disclosure provides security documents which after being put into contact with a staining ink do not recover their original aspect after a chemical treatment, thereby providing an easy way to recognize documents that have been stolen, and are thus unusable and unfit for circulation.

The invention claimed is:

1. A security document comprising:

a substrate;

a protective varnish having a predetermined thickness covering from about 70% to 90% of a surface area of at least one side of the substrate; and an unauthorized access identification area arranged in a remaining about 10% to about 30% of the surface area of the at least one side of the substrate, which comprises at least one staining ink retention zone having either no protective varnish or a layer of the protective varnish having a thickness less than the predetermined thickness, wherein the unauthorized access identification area is configured so that, in the event of a staining ink coming into contact with the at least one staining ink retention zone, the at least one staining ink retention zone permanently and irreversibly retains the staining ink as an indicator of an unauthorized access to the security document, wherein the at least one staining rink retention zone has a shape of lines of guilloches, and wherein the at least one staining ink retention zone has a linewidth between about 100 microns and about 1000 microns.

2. The security document according to claim 1, wherein from about 0% to about 50% of the at least one staining ink retention zone is arranged as at least functional zones, the percentages being based on a total surface of the at least one staining ink retention zone.

3. The security document according to claim 1, wherein the protective varnish is an aqueous varnish or a solvent-based varnish.

4. The security document according to claim 1, wherein the protective varnish is a dual-cure composition combining radiation curable components and physically drying components.

5. The security document according to claim 1, wherein the protective varnish is a UV-Vis curable composition.

6. The security document according to claim 1, wherein the protective varnish comprise one or more security feature substances selected from the group consisting of: UV, Visible or IR-absorbing materials, luminescent materials, forensic markers, taggants, and combinations thereof.

7. The security document according to claim 1, wherein the protective varnish is present on both sides of the security document.

8. The security document according to claim 1, wherein the at least one staining ink retention zone is present on at least one edge or corner of the substrate.

9. The security document according to claim 1, wherein the at least one staining ink retention zone defines indicia.

10. The security document according to claim 1, wherein the substrate comprises material selected from the group consisting of: fibrous materials, plastics, polymers, composite materials, metals, metalized materials, and combinations thereof.

11. The security document according to claim 1, wherein the protective varnish comprises one or more additives selected from the group consisting of: antimicrobial agents, virucidal agents, biocidal agents, fungicides, and combinations thereof.

12. A method for creating the security document having a substrate covered with the protective varnish according to claim 1, said method comprising:

applying the protective varnish on at least one side on substrate by a process selected from the group consisting of offset, gravure, and flexo printing, so as to cover from about 70% to about 90% of the total surface of the one &de of the substrate with the predetermined thickness of the protective varnish, wherein the total surface of the one side of the security document comprises from about 10% to about 30% of the at least one staining ink retention zone, which is configured, in the event of unauthorized access to the security document, to permanently and irreversibly retain the staining ink in the at least one staining ink retention zone as indicative of the unauthorized access, wherein the at least one staining ink retention zone has a shape of lines of guilloches, and wherein the at least one staining ink retention zone has a linewidth between about 100 microns and about 1000 microns.

13. The security document according to claim 1 being a banknote.

* * * * *